US006932534B2

(12) United States Patent
O'Hara

(10) Patent No.: US 6,932,534 B2
(45) Date of Patent: Aug. 23, 2005

(54) NOTEBOOK WITH POUCH COVER

(75) Inventor: Kate O'Hara, Bexley, OH (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

(21) Appl. No.: 10/607,888

(22) Filed: Jun. 27, 2003

(65) Prior Publication Data

US 2004/0265044 A1 Dec. 30, 2004

(51) Int. Cl.[7] ..... B42F 13/00

(52) U.S. Cl. ..... 402/73; 281/15.1; 281/29; 281/31; 402/57; D19/26

(58) Field of Search ..... 281/15.1, 29, 31, 281/36–38, 44, 45, 51; 402/57, 70, 73, 80 R; D19/26, 27, 32

(56) References Cited

U.S. PATENT DOCUMENTS

| | | | | |
|---|---|---|---|---|
| 231,394 A | | 8/1880 | Brown | |
| 709,687 A | | 9/1902 | Vernon | |
| 778,053 A | | 12/1904 | Lindsley | |
| 2,677,376 A | | 5/1954 | Brunner | |
| 4,519,629 A | * | 5/1985 | Podosek | 281/27.2 |
| 4,629,349 A | * | 12/1986 | Pitts | 402/74 |
| 4,907,905 A | * | 3/1990 | Fournier | 402/80 R |
| 5,042,841 A | * | 8/1991 | Friedman | 281/29 |
| 5,378,022 A | | 1/1995 | French et al. | |
| D378,685 S | | 4/1997 | French et al. | |
| D384,972 S | | 10/1997 | French et al. | |
| D418,161 S | | 12/1999 | Tell | |
| 5,997,207 A | * | 12/1999 | Robinson | 402/79 |
| 6,017,164 A | * | 1/2000 | Abbott | 402/73 |
| 6,488,433 B2 | | 12/2002 | Wien et al. | |

* cited by examiner

*Primary Examiner*—Monica S. Carter
(74) *Attorney, Agent, or Firm*—Thompson Hine LLP

(57) ABSTRACT

A notebook including a stack of papers and a pouch having generally the same size and shape in top view as the stack of papers, the pouch including an inner cavity in which loose objects can be stored. The notebook further includes a binding mechanism binding the stack of papers and the pouch together, wherein at least part of the binding mechanism extends through the stack of papers and the pouch to bind the stack of papers and the pouch.

15 Claims, 4 Drawing Sheets

NOTEBOOK WITH POUCH COVER

FIELD OF THE INVENTION

This invention relates to notebooks, and more particularly, to notebooks having a pouch for storage.

BACKGROUND

Many shoppers use lists, such as grocery lists, to keep track of items to be purchased. A common type of notepad which may be used for this purpose may include a stack of paper sheets that are bound together with a gummed adhesive and allow the user to remove, or tear off, individual sheets from the stack of sheets as needed. Other types of notebooks include three-ring binders, clamp-type binders, spiral-bound notebooks and "steno" pads.

Consumers frequently shop or conduct other errands armed with coupons or other loose items in addition to their shopping lists. Coupons are particularly popular with grocery shoppers, who frequently collect a number of coupons. As a result, shopping may become challenging as consumers attempt to simultaneously hold their list, hold their coupons, select and segregate the coupons to be redeemed, and select merchandise to be purchased.

U.S. Pat. No. D378,685, issued to French, et al., discloses a pouch having a plurality of small holes along a longitudinal edge. U.S. Pat. No. 6,488,433, issued to Wien, et al., discloses a binder having an outer transparent window with a zipper to provide access to the inner cavity of the pouch. U.S. Pat. No. 2,677,376, issued to Brunner, discloses a pocket for ring binders, wherein the pocket may be bound together with a stack of papers by a three-ring binder. Lastly, U.S. Pat. No. 5,378,022 to French discloses a pouch which can be slid over the cover of a notebook, such as a spiral bound notebook. However, the prior art fails to provide a solution to the problem of organizing coupons together with a notebook. Other prior attempts to solve this problem include using envelopes and other similar storage containers to store the coupons and list. However, unsealed envelopes are unsatisfactory, because such envelopes do not properly retain the coupons therein. In addition, if the shopping list is kept on a separate sheet, the list can become separated from the coupons.

Accordingly, there is a need for a notebook for making lists and notes. There is a further need for a notebook capable of holding small objects such as coupons. Finally, there is a need for a notebook capable of keeping the objects secure to prevent accidental loss.

SUMMARY

In one embodiment, the invention is a notebook including a stack of papers and a pouch having generally the same size and shape in top view as the stack of papers, the pouch including an inner cavity in which loose objects can be stored. The notebook further includes a binding mechanism binding the stack of papers and the pouch together, wherein at least part of the binding mechanism extends through the stack of papers and the pouch to bind the stack of papers and the pouch.

Other objects and advantages of the present invention will be apparent from the following description and the accompanying drawings.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF THE PREFERRED EMBODIMENT(S)

Figure 1:
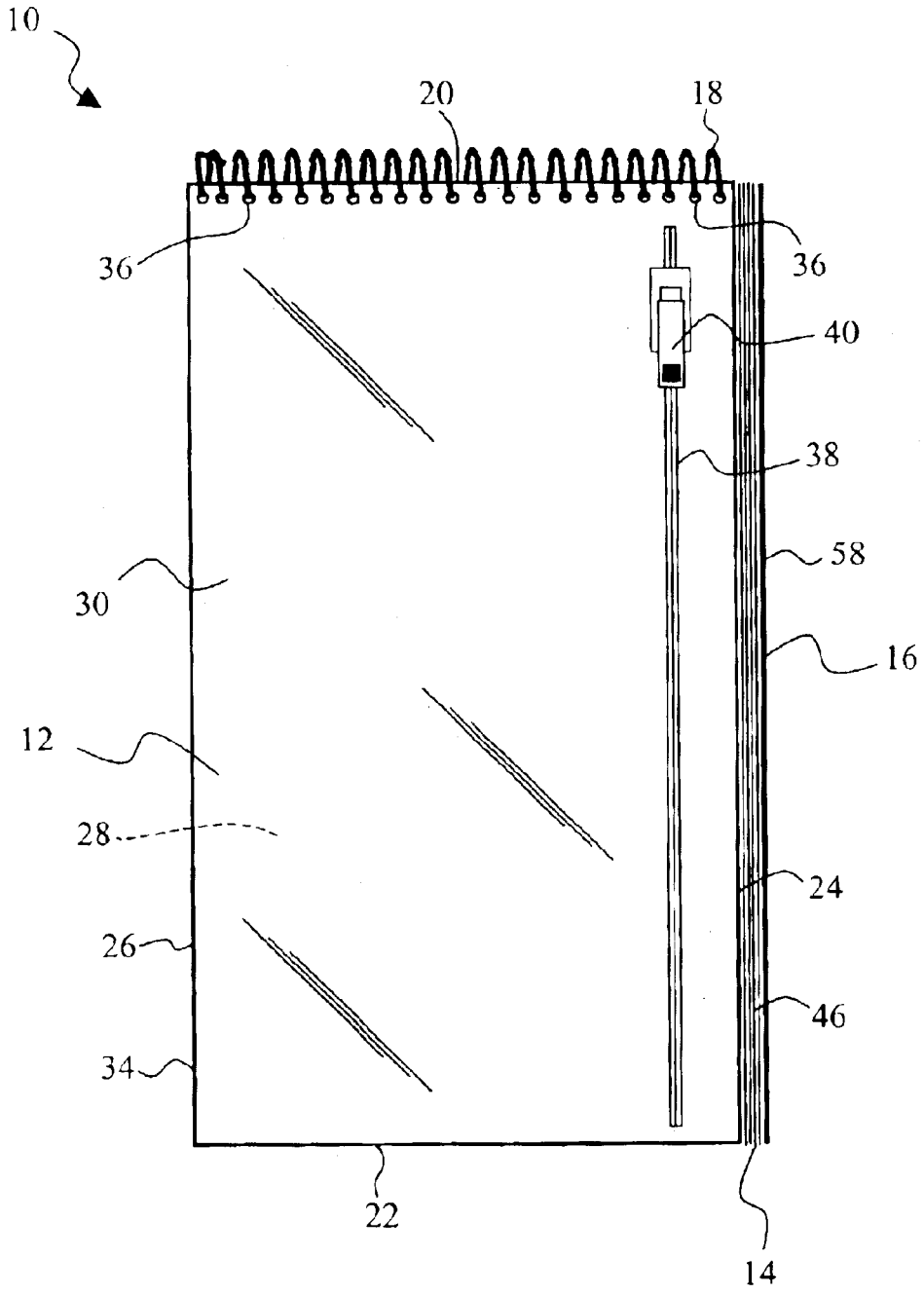
FIG. 1 is a front perspective view of one embodiment of the notebook of the present invention.

The general arrangement of one embodiment of a notebook 10 according to an embodiment of the present invention is shown in FIG. 1. The notebook 10 may include a pocket, pouch or front cover 12, one or more sheets or papers 14 formed into a stack, and a rear cover 16. The pouch cover 12, rear cover 16, and stack of papers 14 may be configured so that the stack of papers 14 may be located between the pouch cover 12 and the rear cover 16 when the notebook 10 is in its closed position. The pouch cover 12, stack of papers 14 and rear cover 16 may be pivotally coupled together by a binder or binding mechanism 18.

The pouch cover 12 may be generally rectangular in top view and have first and second lateral edges 20, 22 and first and second longitudinal edges 24, 26. In one embodiment, each longitudinal edge 24, 26 is about twice as long as each lateral edge 20, 22. The pouch cover 12 may include a cavity 28 formed by or between an upper panel or layer 30 (FIG. 2B) and a lower panel or layer 32. The upper and lower layers 30, 32 may be made of a generally flexible, pliable plastic material so that the cavity 28 or pouch cover 12 can be deformed to accommodate varying sizes and shapes of objects therein. In addition, the upper and lower layers 30, 32 may each be either generally opaque or generally transparent. However, in one embodiment, as will be discussed below, both of the layers 30, 32 may be generally transparent such that the pouch cover 12 is generally transparent.

In the illustrated embodiment the upper and lower layers 30, 32 face each other and are coupled together at their common edges 20, 22, 24, 26 to form a peripheral seal 34 around the cavity 28. The peripheral seal 34 of upper and lower layers 30, 32 may be formed by any appropriate means, such as adhesives, heat sealing and sonic welding.

A series of first or pouch openings 36 may be located proximate to, and extend generally parallel to, the first lateral edge 20. The pouch openings 36 may extend through both the upper and lower layers 30, 32. The pouch cover 12 may also have a slit, opening or mouth 38 to provide access to the cavity 28. The mouth 38 may be selectively opened and closed by a closure mechanism 40. The closure mechanism 40 may be any convenient type of closure mechanism including, but not limited to, a zipper, a slide fastener, snaps, hook-and-loop fasteners, brackets, loops, clips, interengaging shapes and the like.

Figure 3:
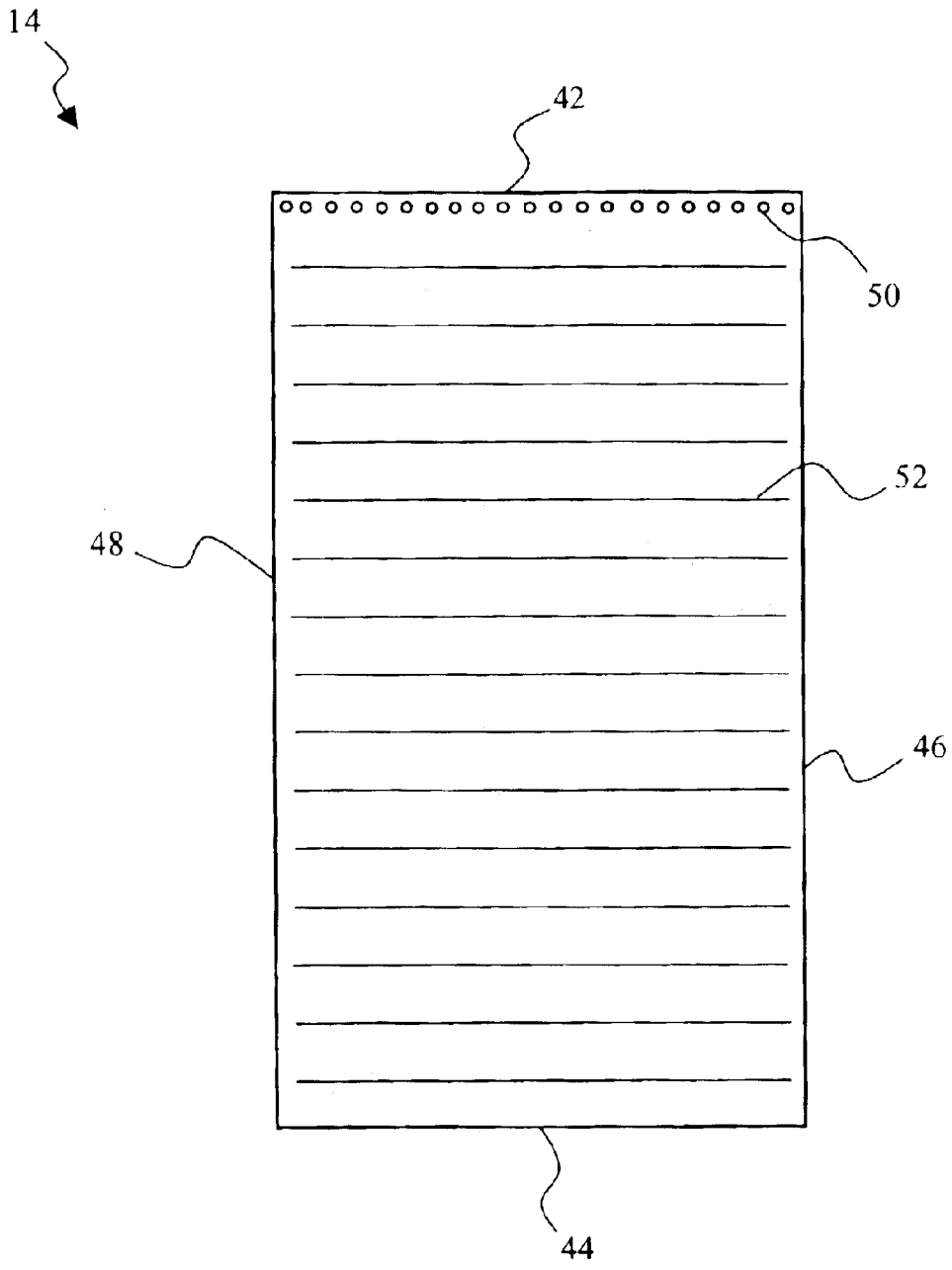
FIG. 3 is a top plan view of a paper sheet of the notebook of FIG. 1.

One embodiment of a paper sheet 14 for the notebook 10 is shown in FIG. 3. The paper sheet 14 may have first and second lateral edges 42, 44 and first and second longitudinal edges 46, 48. A series of second or paper openings 50 may be located proximate to, and extend generally parallel to, the first lateral edge 42. The paper sheet 14 may be white, or may be tinted in one or more colors. The paper sheet 14 may also include printed guidelines 52 extending between the longitudinal edges 46, 48 to guide the user when making notations on the sheet 14.

Figure 4:
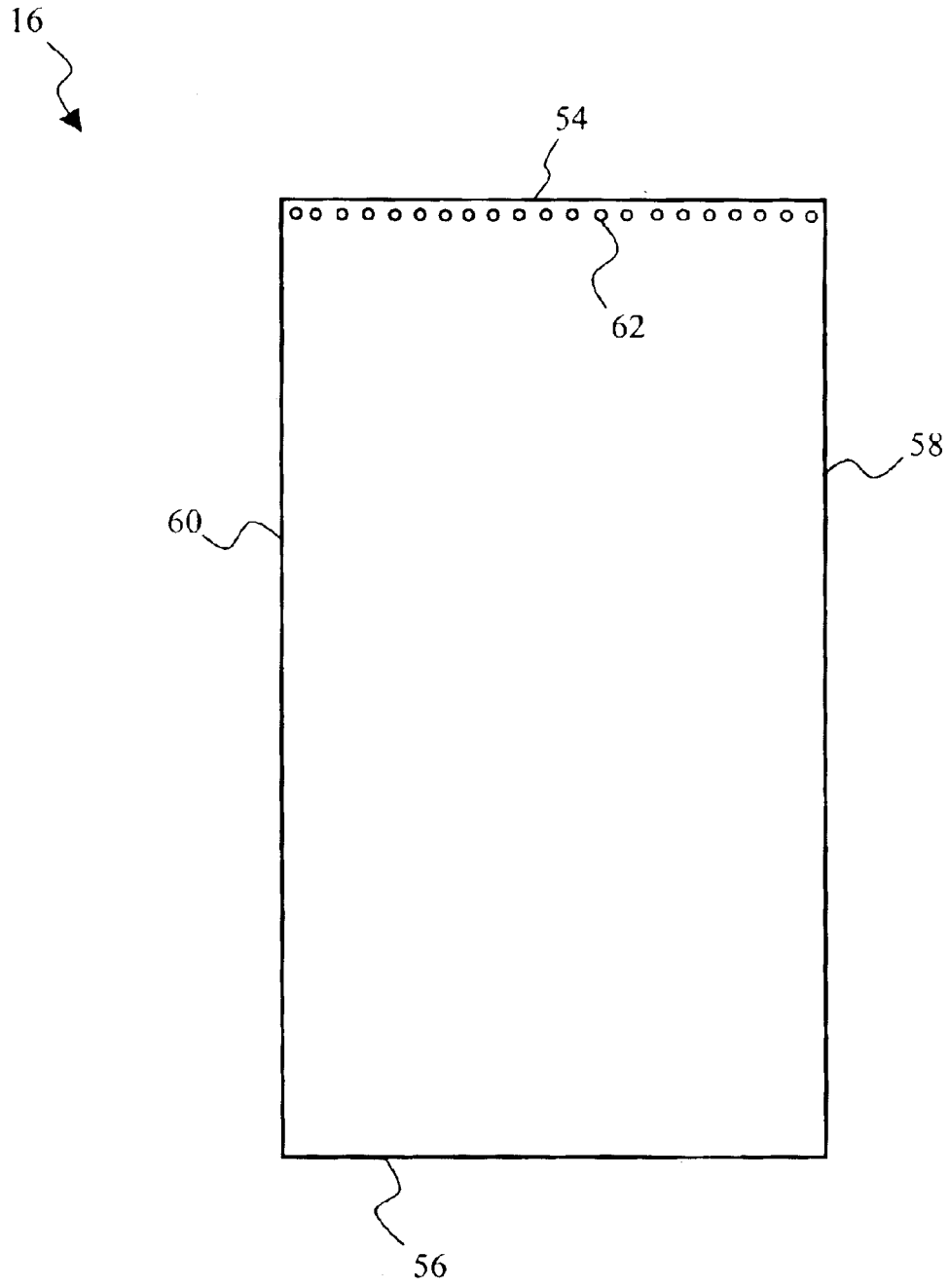
FIG. 4 is a is a top plan view of the rear cover of the notebook of FIG. 1

One embodiment of the rear cover 16 is shown in FIG. 4. The rear cover 16 may have first and second lateral edges 54, 56 and first and second longitudinal edges 58, 60. A series of third or rear cover openings 62 may be located proximate to, and extend generally parallel to, the first lateral edge 54. The rear cover 16 may form a backing for the notebook 10, and may be made from any convenient material, such as cardboard or plastic. The rear cover 16 may have greater stiffness or rigidity than the paper sheets 14 so that the rear cover can act as a support or backing element to lend stiffness to the notebook 10, and to serve as a backing element when the user wishes to write on the paper sheets 14. The rear cover 16 may be a natural color for the material selected, or may be colored.

The binding mechanism 18 may be a spiral-type or coil-type binding mechanism to pivotally connect the pouch cover 12, paper sheets 14 and rear cover 16 to form the notebook 10. In this case, of course, at least part of the binding mechanism 18 extends through the pouch cover 12, stack of papers 14 and rear cover 16. When the binding mechanism 18 is a coil or spiral binder, the binding mechanism extends through the aligned openings 20, 52, 60 to bind the components together. The binder 18 may be made from any appropriate material, such as plastic, composites and metal. The binder 18 may optionally be colored, if desired. In alternate embodiments the binder 18 may take any other convenient form, such as clips, clamps, fasteners, staples, adhesive bindings, etc.

With reference to FIGS. 1–4, the notebook 10 may be assembled by first positioning the pouch cover 12 in relation to the stack of papers 14 such that the mouth 38 faces away from the paper sheets, then placing the paper sheets 14 behind the pouch cover 12 and aligning the paper openings 50 of the paper sheets 14 with the pouch openings 36 of pouch cover 12. The rear cover 16 may then be placed behind the stack of papers 14 such that the rear cover openings 62 of the rear cover 16 are aligned with the openings 36, 50 of the pouch cover 12 and paper sheets 14, respectively. The binder 18 can then be placed or wound through the aligned openings 36, 50, 62 to pivotally connect together the pouch cover 12, paper sheets 14 and rear cover 16.

Figure 2A:
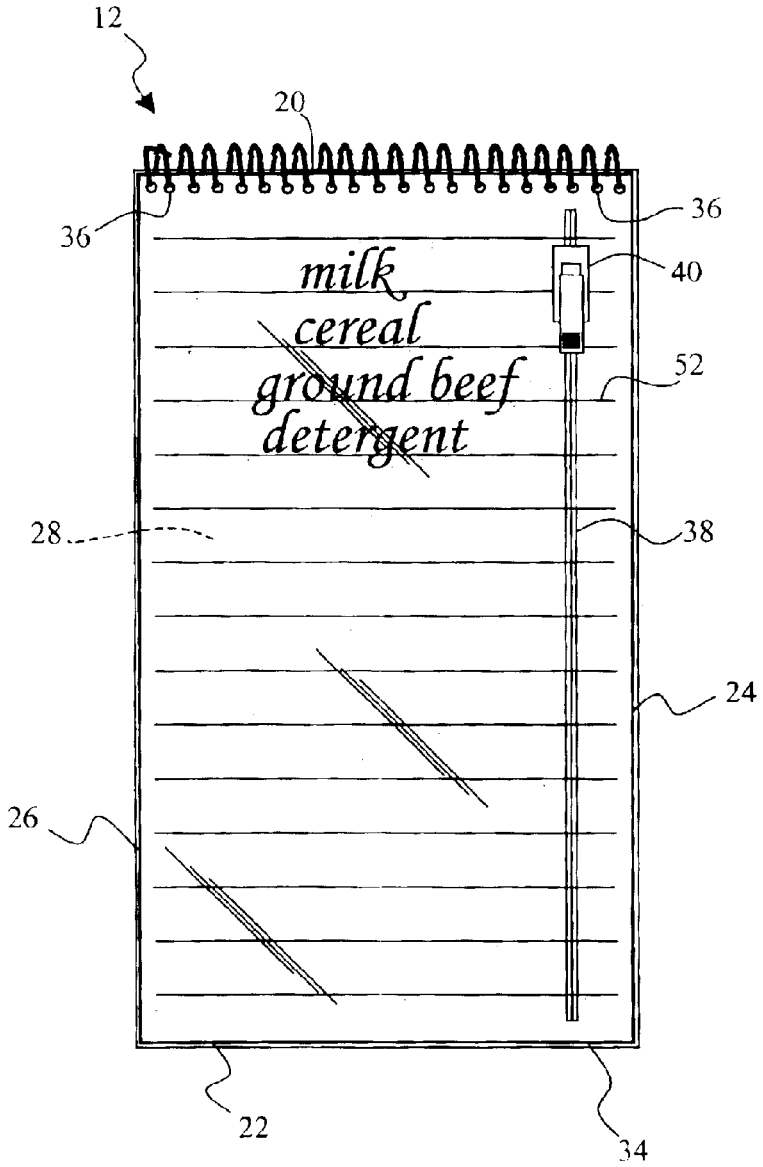
FIG. 2A is a top plan view of the notebook of FIG. 1, wherein the pouch cover is transparent.
Figure 2B:
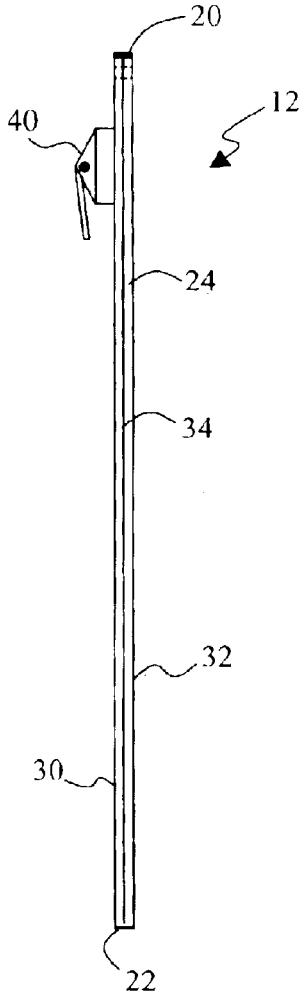
FIG. 2B is a right side elevational view of the cover of a pouch of the notebook of FIG. 1.

As shown in FIG. 2A, in one embodiment the pouch cover 12 (that is, both layers 30, 32) are generally transparent. In this case the top paper sheet of the stack of sheets 14 may be visible, such as when generally no components are received in the cavity 28. In this case, a user can view text written on the top sheet through the pouch cover 12 (or at least part of the text if coupons or other loose items are located in the cavity 28). Further, if at least layer 30 of the pouch cover 12 is generally transparent, the contents of the cavity 28 can be viewed without having to open the pouch cover 12.

As is readily apparent, the present invention offers a number of advantages. The cavity 28 provides a convenient, accessible and secure place to store coupons and other small objects. Further, the transparent upper layer 30 of the cavity 28 allows the user to view the contents of the pouch cover 12 without having to open the mouth 38. In addition, for embodiments of the present invention where layers 30, 32 are both transparent, the user may view the paper sheets 14 through the cavity 28. Since the pouch cover 12 is attached to the notebook 10 by the binding mechanism 18, the pouch and paper sheets 14 are more easily carried and used. The binding mechanism 18 also ensures that the pouch cover 12 and its contents will not be separated from the paper sheets 14. In the event that the cavity 28 is filled, the user may simply lift the pouch cover 12 to view the paper sheets 14 by pivoting the pouch about the binder 18.

From the above description of the invention, those skilled in the art will perceive improvements, changes, and modifications in the invention. Such improvements, changes, and modifications within the skill of the art are intended to be covered.

What is claimed is:

1. A notebook comprising:

a stack of papers;

a pouch having generally the same size and shape in top view as said stack of papers, said pouch including an inner cavity in which loose objects can be stored, said pouch having a first generally flat generally planar panel and a second generally flat generally planar panel oriented generally opposite said first panel with said cavity located therebetween, said pouch having a mouth for accessing the inner cavity;

a binding mechanism binding said stack of papers and said pouch together, wherein at least part of said binding mechanism extends through said stack of papers and said pouch to bind said stack of papers and said pouch; and a rear cover bound to said stack of papers and said pouch by said binding mechanism, said rear cover having a greater stiffness than a paper of said stack of papers and having a size and shape generally similar to said pouch, wherein said notebook is movable to a closed position such that said stack of papers is located between said pouch and said rear cover and wherein said first panel is located between said second panel and said stack of papers when said notebook is in said closed position, and wherein said mouth is located on said second panel of said pouch such that said mouth can be accessed when said notebook is in said closed position.

2. The notebook of claim 1 wherein said binding mechanism is a coil or spiral binding mechanism.

3. The notebook of claim 1 wherein each paper of said stack of papers includes a plurality of printed guidelines located thereon.

4. The notebook of claim 1 wherein said rear cover is bound to said stack of papers and said pouch such that said stack of papers can be located between said pouch and said rear cover.

5. The notebook of claim 1 wherein said pouch is generally transparent.

6. The notebook of claim 1 wherein said first and second panels are joined together at their outer peripheries to form said cavity therebetween.

7. The notebook of claim 6 wherein at least one of the panels is generally transparent.

8. The notebook of claim 1 wherein the pouch includes a closure mechanism for selectively closing and opening the mouth.

9. The notebook of claim 1 wherein said pouch is generally rectangular in top view and includes a pair of lateral edges and a pair of longitudinal edges, and wherein said pouch is bound to said stack of papers along one of said lateral edges.

10. The notebook of claim 9 wherein said pouch is generally aligned with said stack of papers such that the longitudinal and lateral edges of said pouch are aligned with a pair of longitudinal edges and a pair of lateral edges, respectively, of the papers.

11. A notebook, comprising:

a) a front cover comprising:

i) first and second front cover lateral edges, ii) first and second front cover longitudinal edges, iii) an upper layer having a mouth, the mouth being located proximate the first front cover longitudinal edge, iv) a lower layer generally aligned with the upper layer, and v) a first series of openings located proximate the first front cover lateral edge;

wherein the upper and lower layers are peripherally coupled at the first and second front cover lateral edges and at the first and second front cover longitudinal edges to form an inner cavity between said upper and lower layers;

b) at least one paper sheet located under the front cover and comprising:

i) first and second paper lateral edges, generally aligned with the first and second front cover lateral edges respectively, ii) first and second paper longitudinal edges, generally aligned with the first and second front cover longitudinal edges respectively, and iii) a second series of openings located proximate the first paper lateral edge, the second series of openings extending through the paper sheet and being generally aligned with the first series of openings;

c) a rear cover located under the paper sheet, said rear cover having a stiffness greater than said at least one paper sheet and comprising:

i) first and second rear cover lateral edges, generally aligned with the first and second paper lateral edges respectively, ii) first and second rear cover longitudinal edges, generally aligned with the first and second paper longitudinal edges respectively, and iii) a third series of openings located proximate the first rear cover lateral edge, the third series of openings extending through the rear cover and being generally aligned with the first and second series of openings; and d) a binding mechanism extending through the generally aligned first, second and third series of openings to pivotally connect together the front cover, paper sheets, and rear cover, wherein said notebook is movable to a closed position such that said at least one paper sheet is located between said front cover and said rear cover and wherein said lower layer is located between said upper layer and said at least one sheet when said notebook is in said closed position such that said mouth can be accessed when said notebook is in said closed position.

12. The notebook of claim 1 wherein said rear cover is generally rectangular in top view.

13. The notebook of claim 1 wherein said rear cover has a surface area at least as large as each sheet of said stack of papers.

14. A notebook comprising:

a stack of papers;

a pouch having generally the same size and shape in top view as said stack of papers, said pouch including an inner cavity in which loose objects can be stored, said pouch having a first generally flat generally planar panel and a second generally flat generally planar panel oriented generally opposite said first panel with said cavity located therebetween, said pouch having a mouth for accessing the inner cavity;

a binding mechanism binding said stack of papers and said pouch together, wherein at least part of said binding mechanism extends through said stack of papers and said pouch to bind said stack of papers and said pouch; and a rear cover bound to said stack of papers and said pouch by said binding mechanism, said rear cover having a greater stiffness than a paper of said stack of papers and having a size and shape generally similar to said pouch, wherein said notebook is movable to a closed position such that said stack of papers is located between said pouch and said rear cover and wherein said first panel is located between said second panel and said stack of papers when said notebook is in said closed position, and wherein said mouth is positioned on said pouch such that said mouth can be accessed when said notebook is in said closed position.

15. The notebook of claim 14 wherein said mouth is generally not located between said first panel and said stack of papers when said notebook is in said closed position.

* * * * *